US008152021B2

(12) United States Patent
Babikian

(10) Patent No.: US 8,152,021 B2
(45) Date of Patent: Apr. 10, 2012

(54) PAPER TOWEL CABINET WITH PAPER TOWEL SUPPORT BAR

(75) Inventor: Dikran Babikian, Glendale, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 313 days.

(21) Appl. No.: 11/323,119

(22) Filed: Dec. 29, 2005

(65) Prior Publication Data

US 2007/0151980 A1 Jul. 5, 2007

(51) Int. Cl.
*B65H 1/00* (2006.01)

(52) U.S. Cl. ..... 221/45; 221/52; 221/55; 221/56; 221/63

(58) Field of Classification Search ..... 221/1–312 C; 312/34.4–34.7; 211/16
See application file for complete search history.

(56) References Cited

U.S. PATENT DOCUMENTS

| | | | | | |
|---|---|---|---|---|---|
| 1,101,004 | A | * | 6/1914 | Aicher et al. | 221/54 |
| 1,101,378 | A | * | 6/1914 | Aicher et al. | 221/54 |
| 1,110,523 | A | * | 9/1914 | Aicher et al. | 221/54 |
| 1,179,020 | A | | 4/1916 | Marcuse | |
| 1,254,509 | A | | 1/1918 | Kistemann | |
| 1,258,003 | A | | 3/1918 | Hawley | |
| 1,319,281 | A | | 10/1919 | Hoberg | |
| 1,438,320 | A | | 12/1922 | Marcuse | |
| 1,503,241 | A | * | 7/1924 | Horwitt | 221/52 |
| 1,509,048 | A | | 9/1924 | Marcuse | |
| 1,610,670 | A | | 12/1926 | Funk | |
| 1,783,149 | A | * | 11/1930 | Jantzen | 221/34 |
| 2,085,480 | A | * | 6/1937 | Shaffer | 221/54 |
| 3,269,592 | A | | 8/1966 | Slye et al. | |
| 3,713,561 | A | * | 1/1973 | Wyant | 221/44 |
| 3,935,965 | A | | 2/1976 | Stevens | |
| 3,960,291 | A | * | 6/1976 | Navi | 221/36 |
| 4,679,703 | A | | 7/1987 | De Luca | |
| 4,877,154 | A | * | 10/1989 | Matsui | 221/48 |
| 5,065,895 | A | * | 11/1991 | De Luca et al. | 221/54 |

(Continued)

OTHER PUBLICATIONS

Written Opinion of the International Searching Authority for International Application No. PCT/US2006/049676, filed Dec. 29, 2006, Written Opinion dated Jun. 3, 2008 and mailed Jul. 7, 2008 (3 pgs.).

(Continued)

*Primary Examiner* — Michael K Collins
(74) *Attorney, Agent, or Firm* — Christie, Parker & Hale, LLP

(57) ABSTRACT

A paper towel cabinet includes an enclosure and an opening that includes first edge a second edge. The cabinet further includes a dispenser module configured to be housed in the enclosure. The dispenser module includes a pair of generally parallel side walls defining a channel having a dispensing end, and a bar extending between the side walls proximate to the dispensing end. When the dispenser module is disposed in the enclosure with the dispensing end disposed at the opening, the bar extends along the opening between the first edge and the second edge of the opening. When a stack of paper towels is placed in the channel, the bar is disposed between a stack of paper towels and the opening. The paper towel cabinet may also include a bar extending along the opening between the first edge and the second edge without having a dispenser module. The bar may be formed at any one of the first edge or second edge of the opening by an inwardly curved surface formed by any one of the first edge and the second edge.

27 Claims, 6 Drawing Sheets

U.S. PATENT DOCUMENTS

| | | | | |
|---|---|---|---|---|
| 5,074,430 | A * | 12/1991 | Roberts | 221/44 |
| 5,090,592 | A | 2/1992 | Petterson et al. | |
| 5,100,020 | A | 3/1992 | Petterson et al. | |
| 5,102,007 | A | 4/1992 | Petterson et al. | |
| 5,219,092 | A | 6/1993 | Morand | |
| 5,335,822 | A * | 8/1994 | Kasper | 221/259 |
| 5,950,863 | A | 9/1999 | Schutz et al. | |
| 6,003,723 | A | 12/1999 | Morand | |
| 6,053,355 | A * | 4/2000 | Rupp et al. | 221/45 |
| 6,241,118 | B1 | 6/2001 | Tramontina | |
| 6,315,155 | B1 | 11/2001 | Hubanks et al. | |
| 6,378,726 | B1 | 4/2002 | Chan et al. | |
| 6,412,679 | B2 | 7/2002 | Formon et al. | |
| 6,422,416 | B1 | 7/2002 | Tramontina | |
| 6,520,372 | B2 * | 2/2003 | Phelps | 221/34 |
| 6,543,641 | B2 | 4/2003 | Hubanks et al. | |
| 6,553,879 | B2 | 4/2003 | Morand | |
| 6,592,002 | B2 * | 7/2003 | Clark et al. | 221/46 |
| 6,607,093 | B1 | 8/2003 | Morad et al. | |
| 6,779,683 | B2 | 8/2004 | Taylor et al. | |
| 6,899,251 | B2 | 5/2005 | Christensen et al. | |
| 2002/0070228 | A1 | 6/2002 | Moody | |
| 2002/0074340 | A1 | 6/2002 | Phelps | |
| 2003/0057221 | A1 | 3/2003 | Guillemette et al. | |

OTHER PUBLICATIONS

International Search Report for International Application No. PCT/US2006/049676, filed Dec. 29, 2006, International Search Report dated Jun. 3, 2008 and mailed Jul. 7, 2008 (2 pgs.).

* cited by examiner 43
25
42
28
20
22
24
24
40
40
52
26
48
32
46
47
50
44
45
27

PAPER TOWEL CABINET WITH PAPER TOWEL SUPPORT BAR

The present application generally relates to paper towel dispensers, and more particularly, to a paper towel cabinet with paper towel support bar.

BACKGROUND

Paper towel dispensers are either dispensers that dispense individual paper towels from a roll, and dispensers that dispense paper towels from a folded stack of paper towels. The latter type of dispensers typically include a cabinet that is mounted on a wall at a height that allows dispensing of paper towels to a person standing next to the cabinet. One or more stacks of paper towels are placed in the cabinet such that the one or more stacks are oriented vertically inside the cabinet. An opening at the bottom of the cabinet provides access to a paper towel at the bottom of the stack. Paper towels can be manually pulled out of the stack through the opening. The paper towels are folded on top of the each other to form the stack. The fold pattern can be a single-fold, C-fold or multi-fold. The opening is typically an oblong slot having a large center area in order to accommodate various fold configurations and sizes of paper towels.

The above-described paper towel dispensers have several problems. When the stack of paper towels is high, the weight of the stack may cause a bloating of the paper towels at the opening such that a cluster of paper towels are exposed. The bloating may also be caused when the bottom opening does not correspond with the size of paper towels being dispensed from the cabinet. The bloating may allow a user to pull out several paper towels at a time and waste paper towels. The bloating may also cause tearing of paper towels when a user is attempting to pull single paper towels from the stack. In addition to the noted functional disadvantages, bloating of paper towels at the opening is not aesthetically pleasing. When the stack of paper towels is low or almost depleted, the remaining paper towels in the stack may fall out of the opening. When the stack of paper towels is high, the paper towels can tear when being pulled out of the opening because of the friction between the paper towel being pulled out and the bottom of the cabinet at the opening. The tearing of the paper towels is particularly problematic when recycled paper towels are used or when a user's hands are wet.

In view of the above, there is a need for a paper towel cabinet or a module for existing paper towel cabinets that can remedy one or more of the above described problems associated with current paper towel dispensers.

SUMMARY

Features and advantages of the present disclosure will become apparent from the following description of the preferred embodiments, taken in conjunction with the accompanying drawings, which illustrate, by way of example, the principles of the disclosure.

A paper towel cabinet constructed in accordance with the teachings of one aspect of the present disclosure includes an enclosure and an opening having a first edge a second edge. The cabinet further includes a dispenser module configured to be housed in the enclosure. The dispenser module includes a pair of generally parallel side walls defining a channel having a dispensing end, and a bar extending between the side walls proximate to the dispensing end. When the dispenser module is disposed in the enclosure with the dispensing end disposed at the opening, the bar extends along the opening between the first edge and the second edge of the opening. Additionally, when a stack of paper towels is placed in the channel, the bar is disposed between a stack of paper towels and the opening.

A paper towel cabinet constructed in accordance with the teachings of another aspect of the present disclosure includes a pair of generally parallel side walls defining a channel having a dispensing end, an end wall disposed at the dispensing end, and an opening disposed in the end wall. The opening includes a first edge and a second edge. The cabinet further includes a bar extending along the opening between the first edge and the second edge. When the stack of paper towels is placed in the channel, the bar is disposed between a stack of paper towels and the opening.

A paper towel cabinet constructed in accordance with the teachings of yet another aspect of the present disclosure includes a pair of generally parallel side walls defining a channel having a dispensing end, an end wall disposed at the dispensing end, and an opening disposed in the end wall. The opening includes a first edge and a second edge. The cabinet further includes an inwardly curved surface disposed at any one of the first edge and the second edge. When the stack of paper towels is placed in the channel, the inwardly curved surface is disposed between a stack of paper towels and the opening.

DETAILED DESCRIPTION

Figure 1:
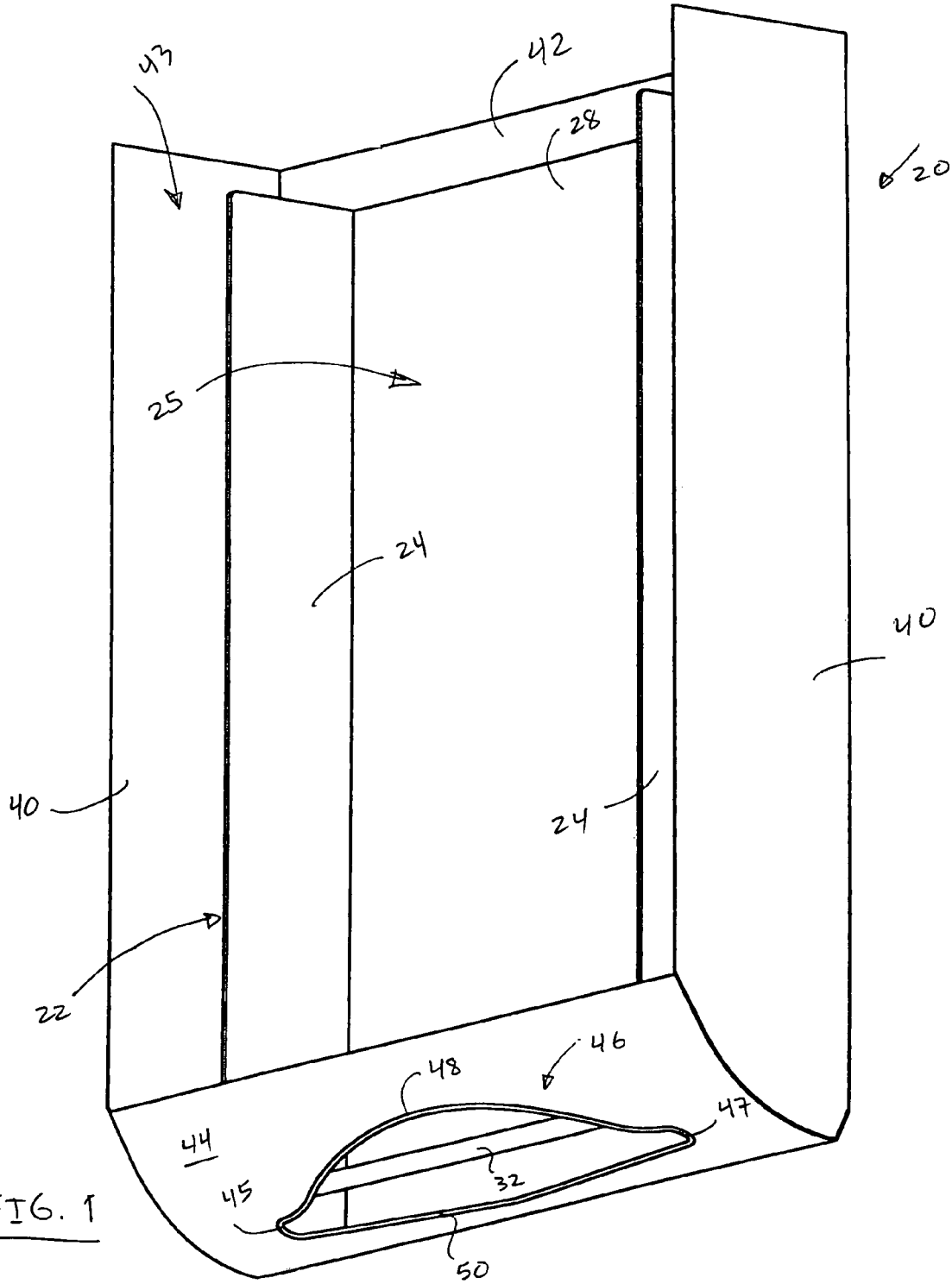
FIG. 1 illustrates a perspective view of a paper towel cabinet constructed in accordance with the teachings of the present disclosure.
Figure 2:
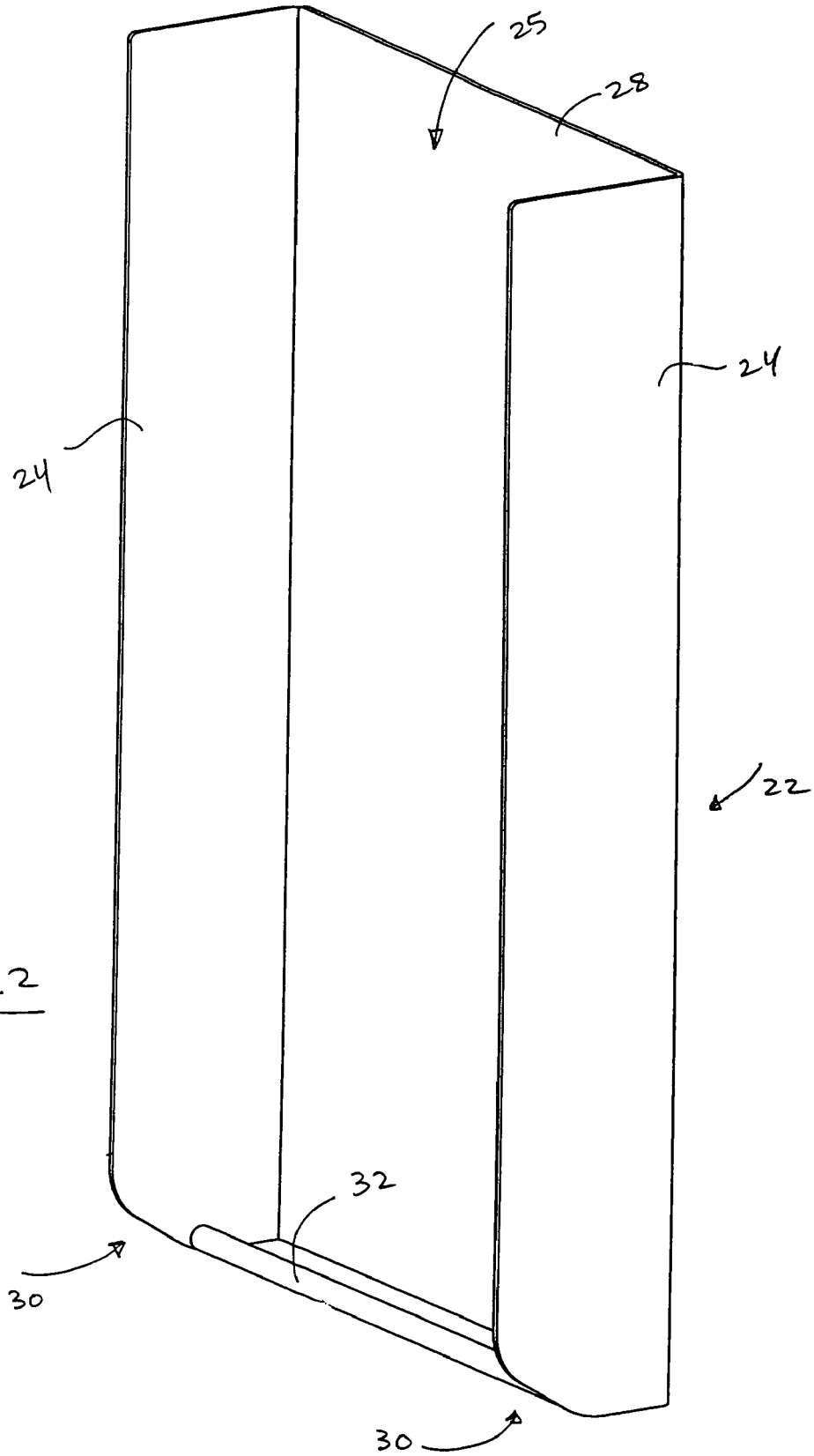
FIG. 2 is a perspective view of a paper towel dispenser module constructed in accordance with the teachings of the present disclosure.

Referring to FIGS. 1-4, a paper towel cabinet 20 having a dispenser module 22 constructed in accordance with the teachings of the present disclosure is shown. Referring to FIG. 2, the dispenser module 22 includes a pair of generally parallel sidewalls 24 that define a channel 25 for housing a correspondingly sized stack of paper towels 26 formed from folded and stacked paper towels 27 (shown in FIG. 4). The dispenser module 22 may also include a back wall 28 that can support the sidewalls 24 and maintain the generally parallel and spaced apart orientation of the sidewalls 24. However, one of ordinary skilled in the art will readily recognize that instead of having the back wall 28, the dispenser module 22 may include one or more structural support members (not shown) that extend between the sidewalls 24 without obstructing the channel 25 to support the sidewalls 24 in the generally parallel and spaced apart position. Any one or both ends of the channel 25 may define a dispensing end 30, from which individual paper towels 27 from the stack of paper towels can be dispensed. In FIGS. 1-4, only one end of the channel 25 is shown as the dispensing end 30. The dispensing module 22 further includes a bar 32 that extends between the sidewalls 24 at or proximate to the dispensing end 30. As shown in FIG. 2, the bar 32 may be generally perpendicular to the sidewalls 24. Additionally, the bar 32 may be either fixedly or rotationally attached to the sidewalls 24.

Figure 3:
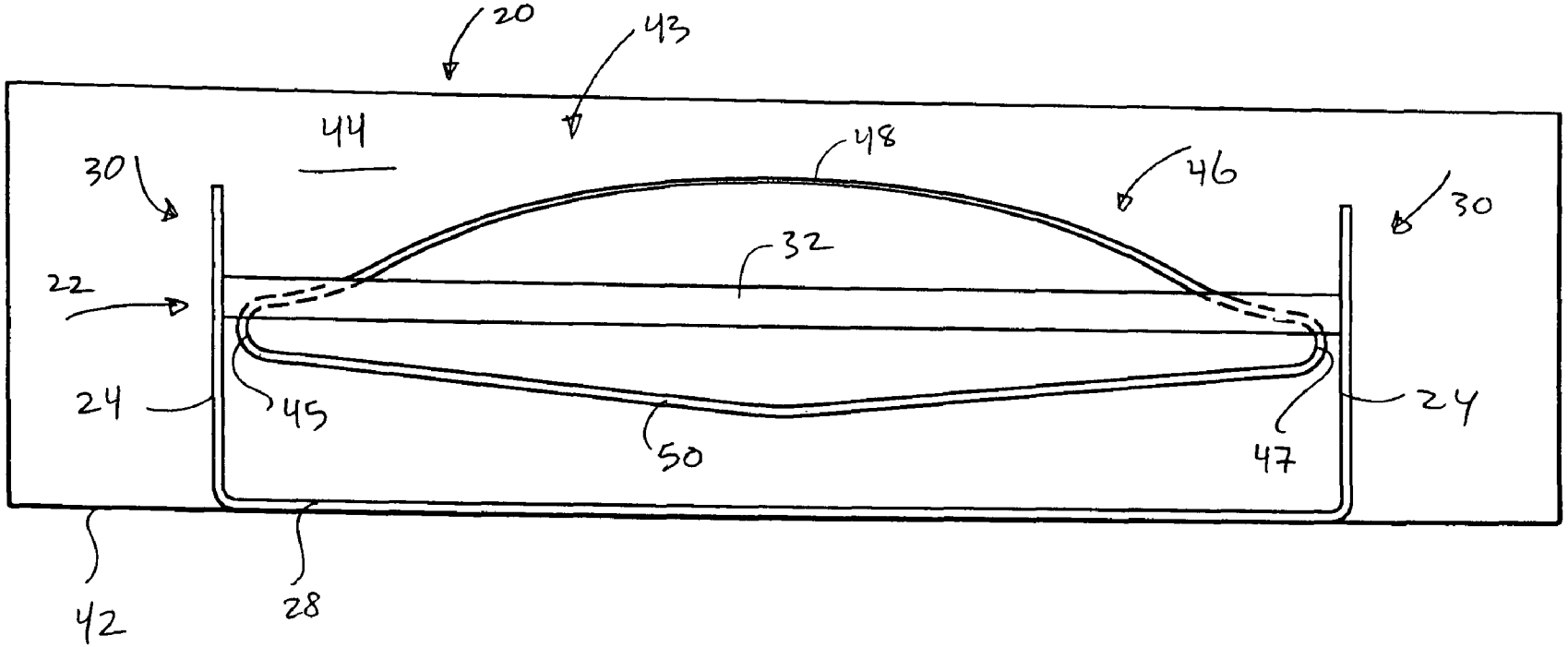
FIG. 3 is a top cross-sectional view of a paper towel cabinet having therein a paper towel dispenser module constructed in accordance with the teachings of the present disclosure.
Figure 4:
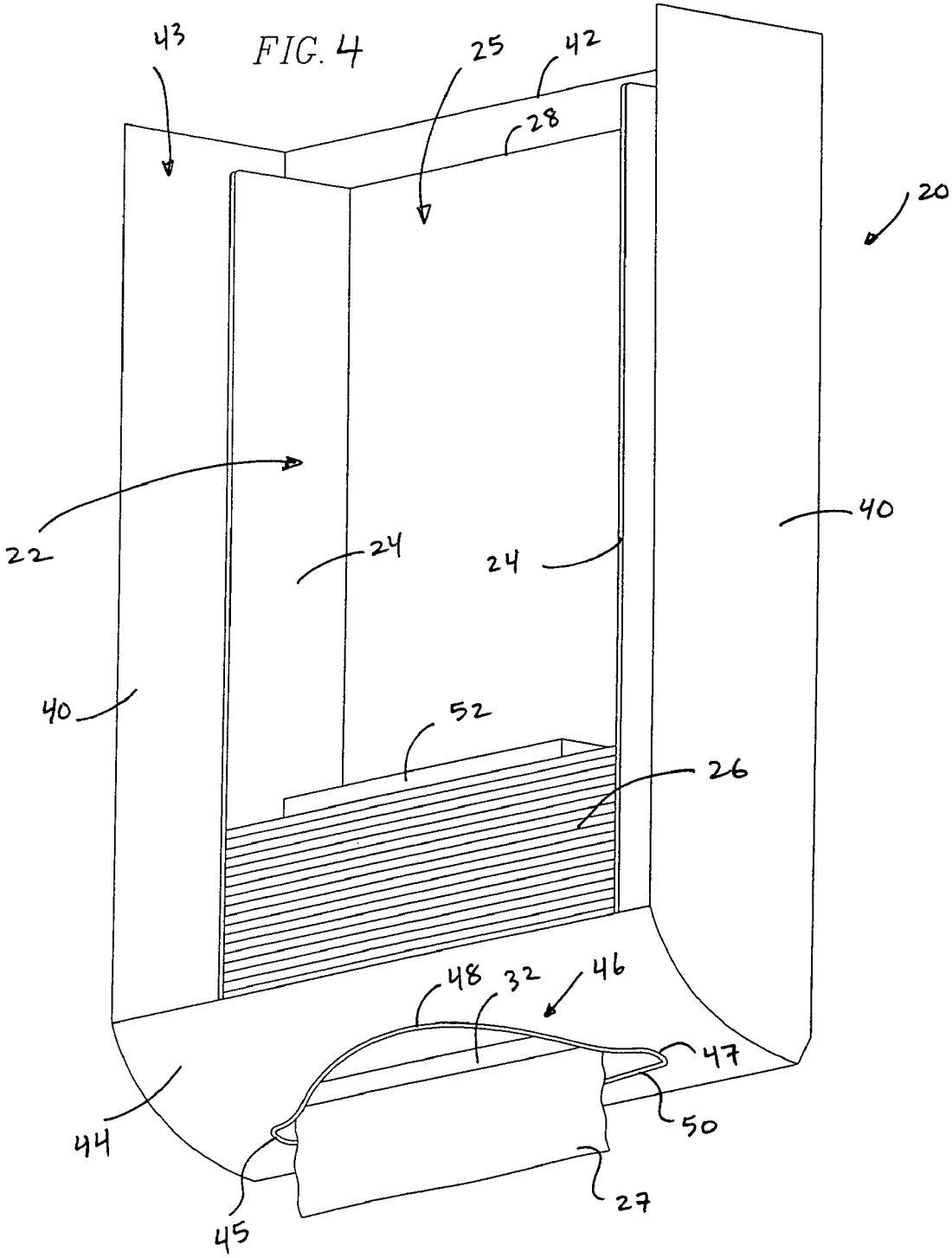
FIG. 4 is the paper towel cabinet and the paper towel dispenser module of FIG. 1 shown with a stack of paper towels therein and a weight placed on top of the stack of paper towels in accordance with the teachings of the present disclosure.

Referring to FIGS. 1, 3 and 4, the cabinet 20 includes a pair of generally parallel sidewalls 40, a back wall 42 and an end wall 44. The cabinet 40 also includes a front wall (not shown) that may be pivotally attached to any one of the sidewalls 40 of the cabinet 20 to provide access to the interior of the cabinet 20. Accordingly, the front wall of the cabinet 20 may function as a door that can provide service access to the interior of the cabinet 20. The sidewalls 40, the back wall 42, the end wall 44 and the front wall define an enclosure 43 for the cabinet 20. The back wall 40 can provide mounting of the cabinet 20 to a wall of a facility in which the cabinet 20 will be used. Accordingly, a user can simply walk up to the cabinet 20 and remove one or more paper towels 27 from the cabinet 20.

The end wall 44 includes an opening 46 having a first side 45 and a second side 47. The opening may be defined by a continuous cutout having a first edge 48 and a second edge 50 that meet at a first side 45 and a second side 47 of the opening 46. To make the end wall 44 either partially visible and/or the opening 46 easily accessible to a user, the end wall 44 can have a slope that is curved upwardly toward the front of the cabinet 20 as shown in FIGS. 1, 3 and 4. Alternatively, although not shown, the end wall 44 may be flat and oriented at an angle relative to the sidewalls 40 so as to be sloped toward the front of the cabinet 20. Furthermore, the first edge 48 may be forwardly curved to provide a large center portion for the opening 46. The resulting shape of the opening 46 allows the cabinet 20 to accommodate different sized paper towels. Additionally, the curvature of the first edge 48 can make the opening 46 visible to a user when the user is standing at the cabinet.

When the dispenser module 22 is placed inside the cabinet 20, all or portions of the dispensing end 30 abut an inner surface of the end wall 44 such that the side walls 24 of the dispenser module 22 assume a substantially parallel position relative to the side walls 40 of the cabinet 20. As shown in FIG. 2, the dispensing end 30 may be shaped to partially or fully correspond with the shape of the inner surface of the end wall 44. Accordingly, the dispenser module 22 assumes a substantially stable position when placed inside the cabinet 20 because the dispensing end 30 can rest fully or partially flush with the end wall 44. When the dispenser module 22 is placed inside the cabinet 20, the bar 32 is positioned inside the cabinet 20 at or proximate to the opening 46. The distance between the bar 32 from the opening may be determined based on a variety of factors, such as the weight, size, thickness, and texture of each paper towel 27. However, the bar 32 is disposed at least near the opening 46 to provide the functionality thereof as described herein.

The bar 32 is positioned relative to the sidewalls 24 of the dispenser module 22 so as to extend along the opening between the first side 45 and the second side 47 of the opening 46 and between the first edge 48 and a the second edge 50 of the opening 46. In FIGS. 1, 3, and 4, the bar is shown to be approximately half way between the first edge 48 and the second edge 50 of the opening 46. Accordingly, the opening 46 is divided by the bar 32 into two substantially similar sized smaller openings from which each paper towel 27 can be pulled out the stack of paper towels 26. If the bar 32 is placed too close to the first edge 48 of the opening 46, the portion of the opening 46 that will be between the bar 32 and the first edge 48 may be too small for pulling out a paper towel 27. The small opening may cause tearing in the paper towels 27 and prevent the edge of the next paper towel to be pulled out from the opening 46. Furthermore, the portion of the opening 46 between the bar 32 and second edge 50 may be too large such that a user can intentionally or unintentionally pull a large number of paper towels 27 from the opening 46. Similarly, if the bar 32 were placed too close to the second edge 50 of the opening 46, the portion of the opening 46 between the bar 32 and the second edge 50 may be too small to be useful for pulling paper towels 27 out of the opening 46. Additionally, the portion of the opening 46 between the bar 32 and the first edge 48 may be too large so that a user can intentionally or unintentionally pull a large number of paper towels 27 from the opening 46.

Each paper towel 27 at the bottom of the stack 26 may either be accessible from behind the bar 32 as shown in FIG. 4, or from the front of the bar 32 (not shown). Once the first paper towel 27 of the stack 26 is pulled out of the opening 46 from either the front of or behind the bar 32, the position of each paper towel 27 relative to the bar 32 will remain as such until the stack of paper towels 26 is completely depleted. However, regardless of whether each paper towel 27 is pulled from the front of or behind the bar 32, the operation of the dispenser module 22 and the bar 32 remains substantially unchanged.

The distance between the sidewalls 24 generally corresponds to the width of the paper towels that will be placed in the channel 25 of the dispenser module 22. Additionally, the length of the sidewalls 24 can be determined to support any size stack of paper towels 26 or multiple stacks of paper towels 26. However, the length of the side walls 24 may be small enough so as to only provide support for the bar 32 and to guide a bottom portion of the paper towel stack 26 toward the opening 46 when the dispenser module 22 is placed in the cabinet 20. Thus, the dispenser module 22 can be sized in any way desired so as to accommodate a particular type of paper towel. Furthermore, the module 22 can be placed in a variety of paper towel cabinets having an opening for dispensing paper towels such that the bar 32 is positioned proximate to the opening as described herein.

As shown in FIG. 4, when the stack of paper towels 26 is placed in the dispenser module 22, the bottom portion of the stack of paper towels 26 may at least partially rest on the bar 32. Accordingly, the weight of the stack of paper towels 26 may be at least partially supported by the bar 32. The weight of the stack of paper towels 26 may also be partially supported by the end wall 44 of the cabinet 20. The bar 32 may be generally circular or have a curved cross-section so as to provide a curved contact surface between itself and each paper towel 27 at the bottom of the stack of paper towels 26. The curved surface of the bar 32 can reduce the resistance encountered by a user pulling each paper towel 27 out of the stack of paper towels 26. The bar 32 may be fixed to the sidewalls 24 such that it cannot rotate when each paper towel 27 is being pulled out of the opening 46. Accordingly, each paper towel 27 slides over the bar 32 while being pulled out of the paper towel stack 26. However, the bar 32 may be rotational relative to the sidewalls 24 so that it freely rotates when each paper towel 27 is being pulled out of the opening 46.

As described above, the weight of the stack of paper towels 26 may be partially supported by the bar 32. The weight of the stack of paper towels 26, however, depends on the number of paper towels 27 that are in the stack 26. As the stack of paper towels is depleted, the weight of the stack 26 is reduced. Accordingly, the frictional force between the paper towel 27 and the bar 32 is reduced and may cause more than one paper towel to fall out or be pulled out of the opening 46. Additionally, when the stack is nearly depleted, the stack becomes light relative to the force by which a user pulls out a paper towel 27 from the bottom of the stack 26. Accordingly, pulling a single paper towel 27 may lift, flip, and/or move the stack 26 so as to disorient the stack relative to the opening 46. The disorientation of the stack 26 may cause the entire stack 26 to fall out of the opening 46, or position the stack 26 such that the remaining paper towels 27 of the stack 26 can be pulled out together. To prevent the stack 26 from being disoriented in the cabinet 20 when nearly depleted, the dispenser module 22 includes a weight 52 that may be placed on top of the stack of paper towels 26. Accordingly, as the stack of paper towels 26 is depleted, the change in the total weight of the stack of paper towels 26 and the weight 52 may not be significant. Thus, even when the stack of paper towels 26 is nearly depleted, the action of pulling a paper towel 27 from the stack 26 may not disorient the stack 26 inside the cabinet 20. Accordingly, with the weight 52 placed on top of the stack of paper towels 26, every paper towel 27 in the stack 26 may be pulled out without disorienting the stack until the stack 26 is completely depleted. The weight 52 can either be placed on top of the stack of paper towels or may be connected to a rail or any type of slide mechanism that is connected to one or both of the sidewalls 24 or any structure that supports the sidewalls 24. Accordingly, the weight 52 cannot be removed from the dispenser module 22.

As described above, the weight 52 biases the paper towel stack 26 toward the opening 46. One of ordinary skill in the art will appreciate that a variety of mechanisms for creating such a bias may be available. For example, the dispenser module 22 may include a plate (not shown) disposed on top of the stack of paper towels 26 that presses on the stack 26 by a spring (not shown). The noted spring bias mechanism may be particularly useful if the cabinet 20 is a small table-top cabinet such that the opening 46 is not disposed at the bottom of the cabinet but on the side of the cabinet 20. Accordingly, the described spring bias mechanism can bias the stack of paper towels 26 toward the opening when the weight of the stack of paper towels 26 alone is not supported by the bar 32 or any portion of the opening 46.

As described in the foregoing, the bar 32 prevents bloating of the stack of paper towels 26 at the opening 46 by partially obstructing the opening 46. Additionally, because the weight of the stack of paper towels 26 is not wholly supported by the inner surface of the end wall 44, the tearing of a paper towel 27 when being pulled out from the opening is prevented or minimized. Furthermore, the module 22 can be sized to accommodate paper towels of any size.

Figure 5:
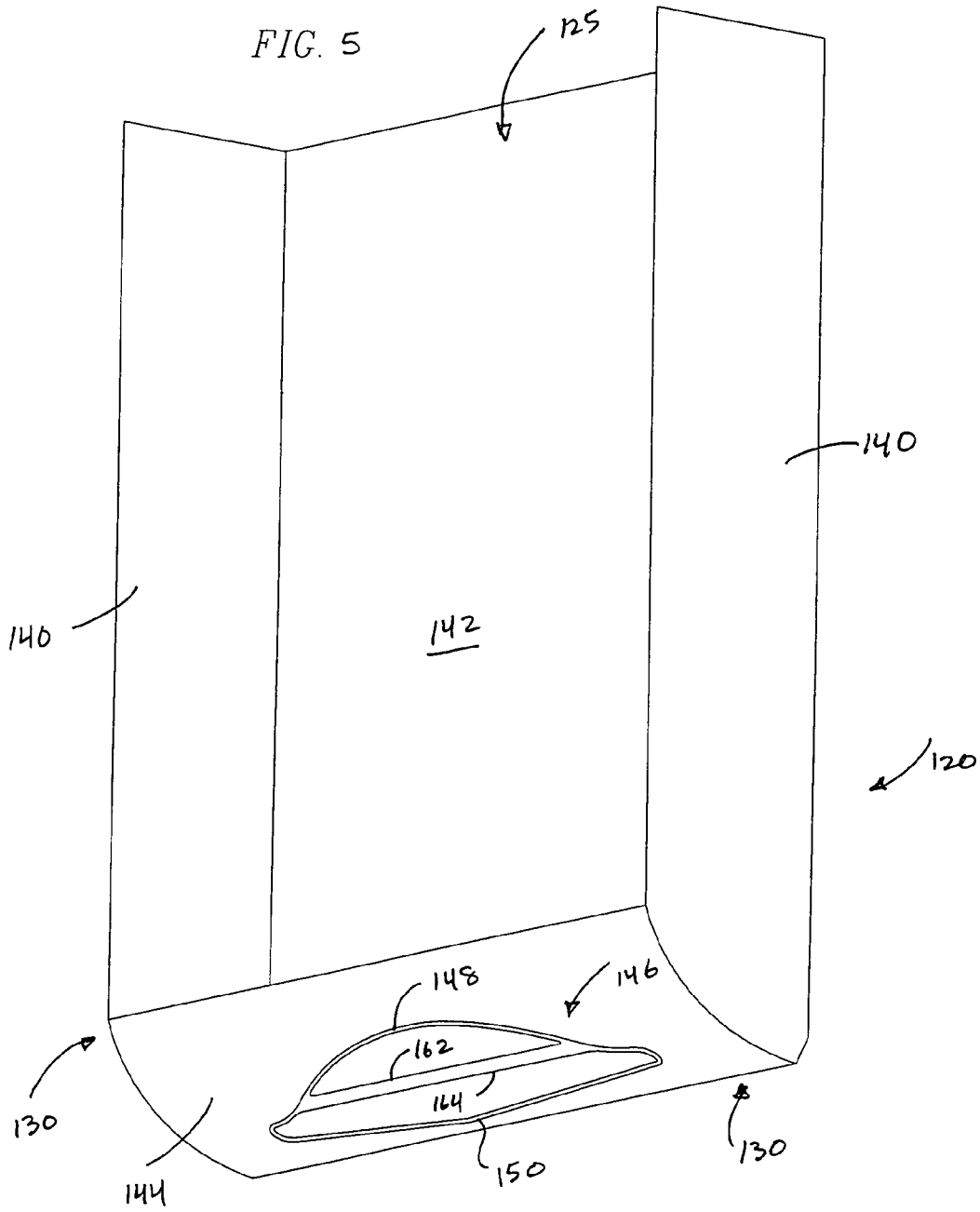
FIG. 5 is fragmentary perspective view of a paper towel cabinet constructed in accordance with the teachings of the present disclosure.

As described above, the bar 32 is a part of the dispenser module 22, which can be used in a paper towel cabinet. However, in accordance with another embodiment of the present disclosure, a paper towel cabinet can include the bar 32 without having therein a dispenser module 22 as described above. Referring to FIG. 5, a cabinet 120 is shown having a pair of sidewalls 140 that define a channel 125 having a dispensing end 130, a back wall 142, an end wall 144 connected to the sidewalls 140 at the dispensing end 130, and an opening 146 in the end wall 144. The opening 146 includes a first edge 148 and a second edge 150 that meet at a first end 145 and a second end 147. The opening 146 includes a pair of inner edges 162 and 164 that are continuous with the first edge 148 and the second edge 150, respectively. The edges 162 and 164 define a bar 132 the functions similar to the bar 32 of the dispenser module 22.

The bar 132 is an integral and continuous part of the opening 146 and may be constructed with the opening 146. For example, the end wall 144 may be constructed from a stainless steel sheet, in which the opening 146 can be cut out, while leaving the portion of the sheet corresponding to the bar 132 uncut. Alternatively, the shape of the opening 146 can be stamped out of the sheet. To provide the generally circular or curved inner surface of the bar 132, as described above in relation to the dispenser module 22, the inner edges 162 and 164 can be curled (i.e., bent in a curved manner) downward and away from the opening 146. Accordingly, the a curved inner surface corresponding to the bar 132 can be formed inside the cabinet 120. The curved inner surface of the bar 132 can provide a functionality similar to the bar 32 of the dispenser module 22. Alternatively, instead of the bar 132 being integral and continuous with the opening 146, the cabinet 120 may be identical in every respect to the cabinet 20, except that a bar 132 can be attached to the cabinet 120 at the opening 146. Accordingly, existing paper towel cabinets can be modified to include the bar 132 in accordance with the teachings of the present disclosure by simply having a bar 132 attached to the opening 146 thereof.

Figure 6:
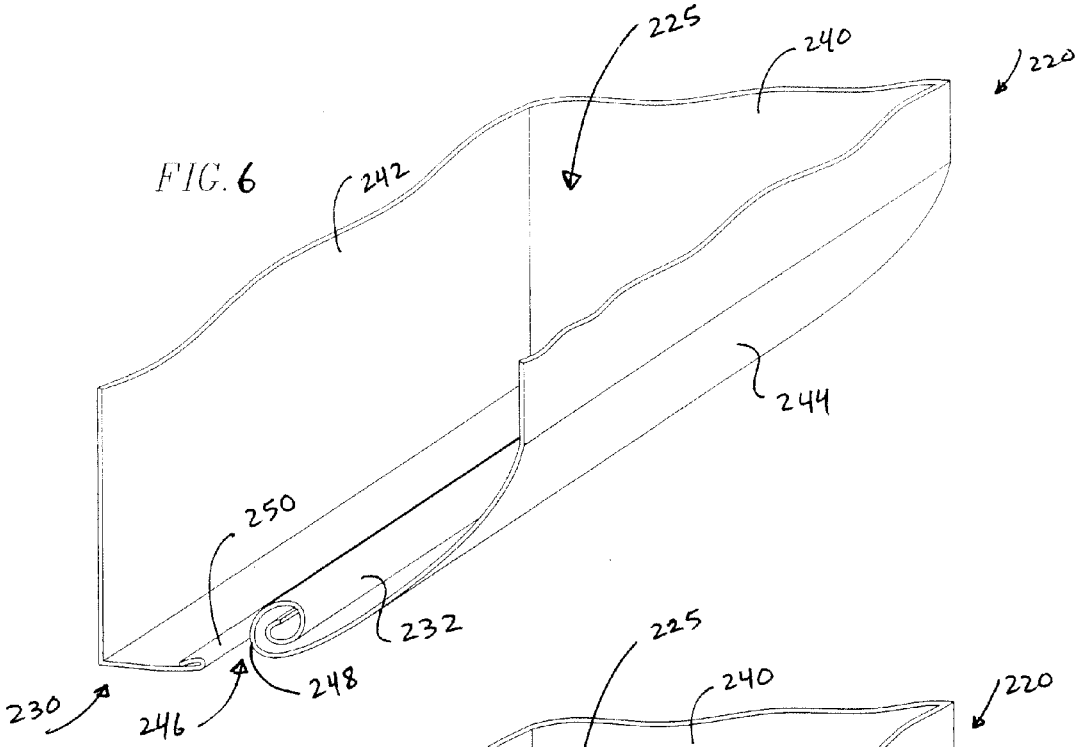
FIG. 6 is a fragmentary perspective cross-sectional view of a paper towel cabinet constructed in accordance with the teachings of the present disclosure.
Figure 7:
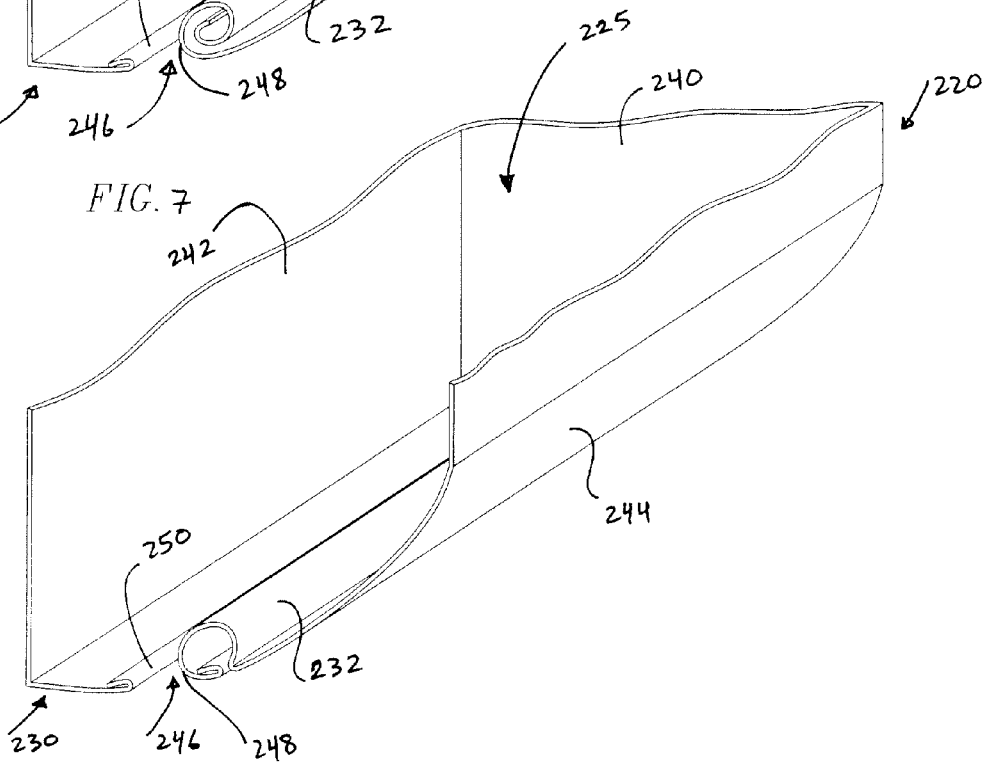
FIG. 7 is another example of the paper towel cabinet of FIG. 6.

Referring to FIGS. 6 and 7, another embodiment of the present disclosure is shown where a bar is integral and continuous with the opening of the cabinet. The cabinet 220 includes a pair of sidewalls 240 (only one shown) defining a channel 225 having a dispensing end 230, a back wall 242, and an end wall 244 connecting the sidewalls 240 at the dispensing end 230 and having an opening 246. The opening includes a second edge 250 and a first edge 248 that meet at a first end (not shown) and a second end (not shown). The opening 246 of the cabinet 220 is a narrow slit and may not include a large center portion similar to the openings 46 and 146 of the cabinets 20 and 120, respectively. Accordingly, instead of having a distinct bar between the first edge 248 and the second edge 250 that may obstruct the slit shaped opening 246, a bar 232 can be provided continuous with the first edge 248. The first edge 248 of the cabinet 240 is curved inward relative to the opening 246 so as to define a generally circular or curved inner surface inside the cabinet 220 that defines the bar 232 in accordance with the teachings of the present disclosure.

The bar 232 can be co-manufactured with the end wall 244 and the opening 246. For example, the end wall 244 may be constructed from a stainless steel sheet, in which the opening 246 can be cut out. Alternatively, the shape of the opening 246 can be stamped out of the sheet. To provide the generally circular or curved inner surface that defines the bar 232, as described above in relation to the dispenser module 22, the first edge 248 can be curled (i.e., bend in a curved shape) inward. Accordingly, a curved inner surface corresponding to the bar 232 can be formed inside the cabinet 220. The curved inner surface of the bar 232 can provide a functionality similar to the bar 32 of the dispenser module 22. Alternatively, instead of the bar 232 being integral and continuous with the opening 246, the bar 232 can be attached to the cabinet 220 at the opening 246. Accordingly, existing paper towel cabinets having a slit shaped opening 246 can be modified to include the bar 232 in accordance with the teachings of the present disclosure by simply having a bar 232 attached to the first edge 248 of the opening 246.

From the foregoing, it will be appreciated that the paper towel cabinet and the dispenser module for a paper towel cabinet constructed in accordance with the teachings of the present disclosure prevent bloating of paper towels near the opening of a paper towel cabinet, allows different size paper towels to be used in any type of paper towel cabinet, prevent misuse of the paper towels in the cabinet by substantially preventing several paper towels to be pulled out of the cabinet at the same time, prevent paper towels from falling out of the opening of the cabinet when the stack of paper towels is at a low level, and/or prevent tearing of paper towels while being pulled out of the opening when the stack of paper towels is at a high level.

While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. A paper towel cabinet for dispensing paper towels, the cabinet comprising:

a pair of side walls defining a channel to receive a stack of folded paper towels, the channel having a dispensing end;

an end wall disposed at the dispensing end;

an end wall opening disposed in the end wall, the end wall opening having a length that extends in a direction from one of the pair of side walls to the other of the pair of side walls, the end wall opening having a first side and a second side, the first side and the second side extending along the length of the end wall opening and spaced apart along a width of the end wall opening;

a bar having a length extending along the length of the end wall opening between the first side and the second side and configured to at least partially support said stack of folded paper towels placed in the channel, said bar being translationally fixed relative to the first and second sides;

wherein the bar divides said end wall opening into a first paper towel dispensing opening between the bar and the first side of the end wall opening and a second paper towel dispensing opening between the bar and the second side of the end wall opening, wherein each of said first and second paper towel dispensing openings are configured for allowing for the dispensing of said paper towels through each of said first and second paper towel dispensing openings during a normal paper towel dispensing operation of said paper towel cabinet; and wherein the length of the end wall opening is greater than the width of the end wall opening.

2. The paper towel cabinet of claim 1, wherein the bar extends along the end wall opening at approximately at an equal distance from the first side and the second side.

3. The paper towel cabinet of claim 1, further comprising a bias mechanism configured to force the stack of paper towels toward the bar.

4. The paper towel cabinet of claim 3, wherein the bias mechanism comprises a weight disposed on top of the stack of paper towels.

5. The paper towel cabinet of claim 1, wherein the bar is fixed to the pair of side walls.

6. The paper towel cabinet of claim 1, wherein the bar is rotationally coupled to the pair of side walls.

7. The paper towel cabinet of claim 1, wherein the bar comprises a generally curved cross section.

8. The paper towel cabinet of claim 1, further comprising a loading opening configured for placing said folded paper towels inside the channel through the loading opening, wherein the loading opening is different from the end wall opening.

9. The paper towel cabinet of claim 1, wherein the bar is fixed in translation between the first side and the second side of the end wall opening.

10. The paper towel cabinet of claim 1, wherein the first paper towel dispensing opening and the second paper towel dispensing opening are unobstructed.

11. The paper towel cabinet of claim 1, comprising only a single bar disposed above the end wall opening between the stack of paper towels and the end wall opening when the stack of paper towels is in the channel.

12. The paper towel cabinet of claim 1, wherein the end wall opening has a fixed size during dispensing of the paper towels through the end wall opening.

13. The paper towel cabinet of claim 1, wherein the bar is disposed above the end wall opening between the stack of paper towels and the end wall opening when the stack of paper towels is in the channel.

14. The paper towel cabinet of claim 1, wherein the bar is integrally formed with the end wall opening.

15. The paper towel cabinet of claim 1, wherein said bar is a rotating bar.

16. A paper towel cabinet comprising:

an enclosure having a pair of side walls;

an end wall connected to the enclosure and having an opening having a length that extends in a direction from one of the pair of side walls of the enclosure to the other of the pair of side walls of the enclosure, the opening including a first edge, a second edge, the first edge and the second edge extending along the length of the opening and spaced apart along a width of the opening; and a dispenser module housed in the enclosure, the dispenser module comprising:

a pair of side walls defining a channel to receive a paper towel, the channel having a dispensing end; and a bar having a length extending between the side walls of the dispenser module proximate to the dispensing end;

wherein the length of the bar extends along the length of the opening between the first edge and the second edge of the opening when the dispenser module is disposed in the enclosure with the dispensing end disposed at the opening;

wherein the bar is disposed between the stack of paper towels and the opening when the stack of paper towels is placed in the channel, and wherein the bar defines a first paper towel dispensing space between the bar and the first edge and a second paper towel dispensing space between the bar and the second edge; and wherein the length of the opening is greater than the width of the opening.

17. The paper towel cabinet of claim 16, wherein the dispenser module is removably disposed in the enclosure.

18. The paper towel cabinet of claim 16, wherein the bar extends along the opening at an approximately equal distance from the first edge and the second edge.

19. The paper towel cabinet of claim 16, wherein the dispenser module further comprises a bias mechanism configured to force the stack of paper towels toward the bar.

20. The paper towel cabinet of claim 19, wherein the bias mechanism comprises a weight disposed on top of the stack of paper towels.

21. The paper towel cabinet of claim 16, wherein the bar is fixed to the pair of side walls of the dispenser module.

22. The paper towel cabinet of claim 16, wherein the bar is rotationally coupled to the pair of side walls of the dispenser module.

23. The paper towel cabinet of claim 16, wherein the bar comprises a generally curved cross section.

24. The paper towel cabinet of claim 16, wherein the bar is integrally formed with the dispensing end.

25. The paper towel cabinet of claim 16, wherein the bar is translationally fixed relative to the first and second edges.

26. The paper towel cabinet of claim 25, wherein said bar is a rotating bar.

27. The paper towel cabinet of claim 16, wherein said bar is a rotating bar.

* * * * *